US005807210A

United States Patent [19]

Devlin

[11] Patent Number: 5,807,210

[45] Date of Patent: Sep. 15, 1998

[54] TEETER-TOTTER EXERCISER WITH ROTATING FOOT PEDALS AND METHOD OF ITS USE

[76] Inventor: C. Tim Devlin, 130 Carlton-on-thePark, Toronto, Ontario, Canada, M5A 4K3

[21] Appl. No.: 903,421

[22] Filed: Jul. 30, 1997

[51] Int. Cl.[6] ..... A63B 22/04

[52] U.S. Cl. ..... 482/52; 482/51; 482/71; 482/79; 482/146

[58] Field of Search ..... 482/51, 52, 71, 482/78, 79, 80, 110, 112, 131, 132, 146–148, 139, 907, 908; 601/23, 27, 29, 31–34, 84, 89, 90, 92, 97, 98, 112; 273/449; 472/14, 25, 26, 40; 434/258, 260, 261; D21/191, 193

[56] References Cited

U.S. PATENT DOCUMENTS

| | | | |
|---|---|---|---|
| D. 281,343 | 11/1985 | Krive | D21/192 |
| 2,206,902 | 7/1940 | Kost | 128/25 |
| 3,441,271 | 4/1969 | Palacios | 272/33 |
| 3,511,500 | 5/1970 | Dunn | 272/79 |
| 3,612,519 | 10/1971 | Larson | 272/57 A |
| 3,911,907 | 10/1975 | Smith, Jr. | 128/24 |
| 4,629,181 | 12/1986 | Krive | 272/97 |
| 4,830,362 | 5/1989 | Bull | 272/70 |
| 5,078,389 | 1/1992 | Chen | 272/70 |
| 5,284,461 | 2/1994 | Wilkinson | 482/53 |
| 5,298,002 | 3/1994 | Lin | 482/53 |
| 5,453,065 | 9/1995 | Lien | 482/52 |
| 5,518,470 | 5/1996 | Piaget | 482/51 |
| 5,520,596 | 5/1996 | Johnston | 482/52 |
| 5,527,253 | 6/1996 | Wilkinson | 482/147 |
| 5,545,111 | 8/1996 | Wang et al. | 482/53 |
| 5,575,739 | 11/1996 | Piaget et al. | 482/51 |

*Primary Examiner*—Jeanne M. Clark
*Attorney, Agent, or Firm*—Riches, McKenzie & Herbert

[57] ABSTRACT

A stepper exerciser of the teeter-totter type with foot platforms maintained horizontal and in which the foot platforms are rotatable about a vertical axis and its method of use.

14 Claims, 13 Drawing Sheets

TEETER-TOTTER EXERCISER WITH ROTATING FOOT PEDALS AND METHOD OF ITS USE

SCOPE OF THE INVENTION

The present invention relates to an exercise apparatus and, more particularly, to an exercise apparatus including a teeter-totter like exerciser carrying two spaced horizontally disposed foot platforms each of which are rotatable about a vertical axis.

BACKGROUND OF THE INVENTION

Stepper exercise devices having a teeter-totter action are known as taught, for example, in U.S. Pat. No. 3,511,500 to Dunn, issued May 12, 1970; U.S. Pat. No. 5,298,002 to Lin, issued Mar. 29, 1994 and U.S. Pat. No. 5,518,470 to Piaget et al, issued May 21, 1996.

The present inventor has appreciated that such known devices suffer from the disadvantage that a user on using the apparatus adopts a set orientation of his feet and body on the apparatus and, typically, exercises in that orientation. To move the different orientations requires at least the lifting and movement of the user's feet relative the apparatus. The present inventor has appreciated that these known devices suffer the disadvantage that they are not conducive to exercising in a manner with a smooth transition from one relative orientation of the body on the exerciser to other orientations.

SUMMARY OF THE INVENTION

To at least partially overcome these disadvantages of previously known devices, the present invention provides an exerciser of the teeter-totter type with foot platforms maintained horizontal and in which the foot platforms are rotatable about a vertical axis.

An object of the present invention is to provide a novel exerciser comprising a combination teeter-totter device and twister.

Another object is to provide a novel method of exercising.

Accordingly, in one aspect, the present invention provides an exercise device having a base member with a teeter-totter mechanism mounted thereto. The teeter-totter mechanism comprises an elongate primary pivot lever having first and second end portions with the primary lever pivotally mounted intermediate its first and second end portions on the base member for pivoting about a horizontal primary axis. First and second foot platform support members are respectively mounted on the first and second end portions of the primary lever for pivoting relative the primary lever about respective first and second pivot axes parallel the primary axis. Each first and second foot platform support members carry respectively an upwardly directed first and second foot platform. A linkage mechanism is provided which maintains each of the first and second foot platforms horizontal with pivoting of the primary lever about the primary axis. Each of the first and second foot platforms, respectively, are mounted to and above the first and second foot platform support members journalled for rotation thereon about respective first and second vertical axes preferably centrally of each of the respective of the first and second foot platforms.

The exercise device may include an adjustable resistance mechanism for providing adjustable resistance to pivoting of the primary lever relative the base member about the primary axis. A resistance mechanism is not necessary and one preferable embodiment of the invention is without a resistance mechanism. If a resistance mechanism is provided, it is preferred that it be adjustable as to the resistance imparted. The adjustable resistance mechanism preferably is adjustable so as to permit adjustment over a range which includes providing no resistance. Suitable resistance mechanisms may include hydraulic cylinders, clutch friction plates, pneumatic cylinders, springs and the like.

Each of the first and second foot platforms preferably comprise circular discs journalled for rotation about the centre of each disc and preferably having a size larger than that of a foot of a user. Preferably, one or more hand support members are provided secured to the base member and extending upwardly on one of the sides, front or back of the exerciser and which can be grasped by one or more hands of a user to assist in steadying a user in balance when using the exerciser.

The invention also provides a method of exercising using an exercise device in accordance with the present invention. In the method of exercising, the user mounts the exerciser device with the weight of the user supported on the device and with one foot of the user on one foot platform and the other foot of the user on the other foot platform. To exercise in accordance with the invention of this application, a user maintains contact of his feet with each of the two foot platforms and with his feet maintained in continuous contact reciprocally pivots the lever member by applying varying weight distribution to the different foot platforms and while simultaneously pivoting one or more of the foot platforms about its vertical axis. Preferably, in such pivoting, the user moves to different positions as, for example, from positions in which the user has both feet parallel each other to positions in which the user's feet are not parallel. As well, the user may adopt positions in which the lower torso is directed in the same direction as the feet or positions in which the lower torso is directed in directions perpendicular or at different directions than one or both of the feet. The method of exercising has the advantage of permitting smooth continuous movement from one relative orientation of the feet and/or torso of a user on the apparatus to other related positions in a fluid and continuous motion by keeping the balls of one's feet centred on the footplates above the axis of each footplate simultaneously with positioning the teeter-totter mechanism in different angular orientations and/or maintaining continuous reciprocal movement of the teeter-totter device. In this manner, relatively unique stretching and muscular combinations for exercises and the like can be adopted while promoting development of skills in dexterity, agility and balance.

BRIEF DESCRIPTION OF THE DRAWINGS

Further aspects and advantages of the present invention will become apparent from the following description taken together with accompanying drawings in which.

DETAILED DESCRIPTION OF THE DRAWINGS

Figure 1:
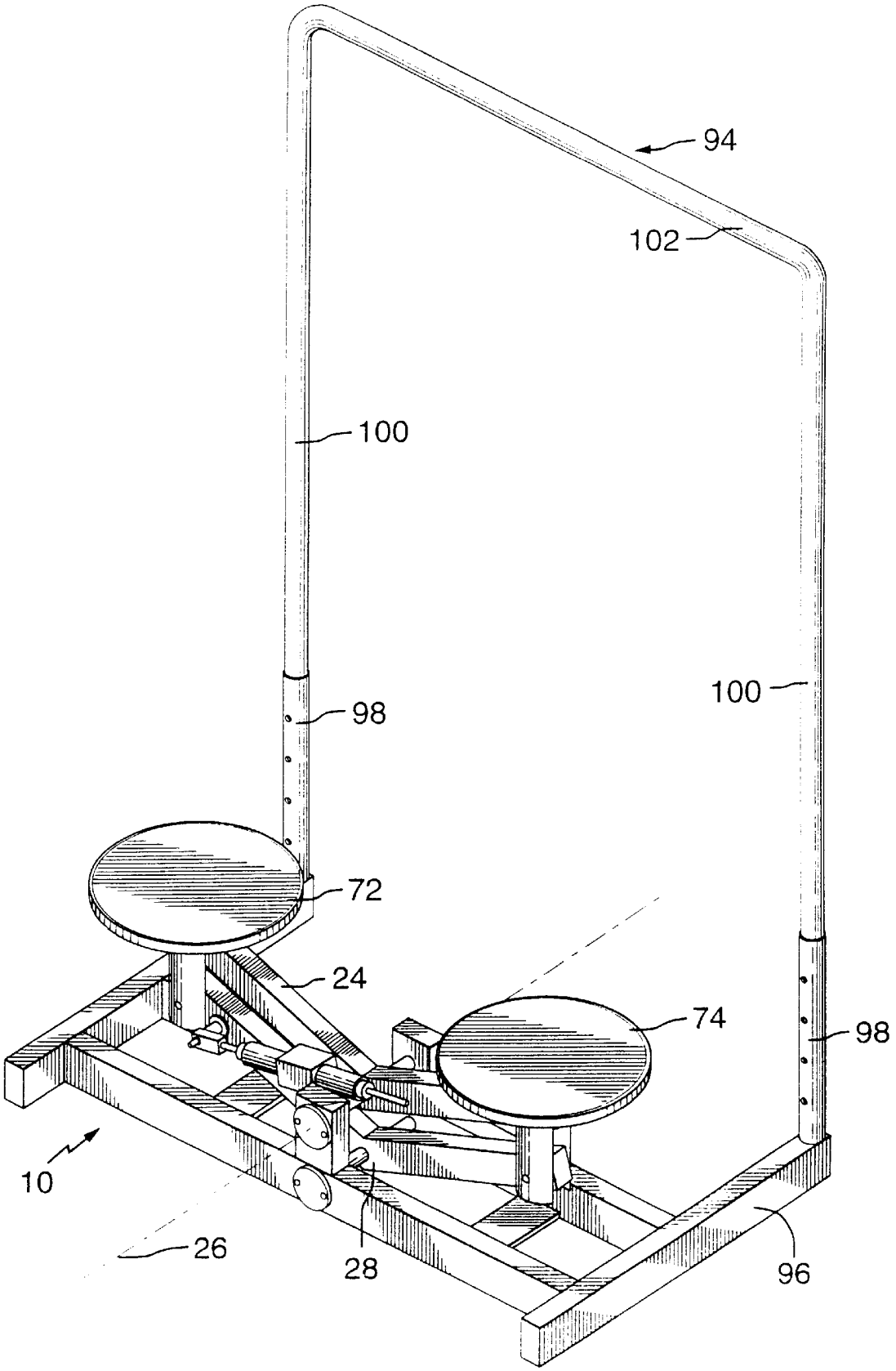
FIG. 1 is a perspective view of a first preferred embodiment of an exerciser in accordance with the present invention including a hand rail.
Figure 2:
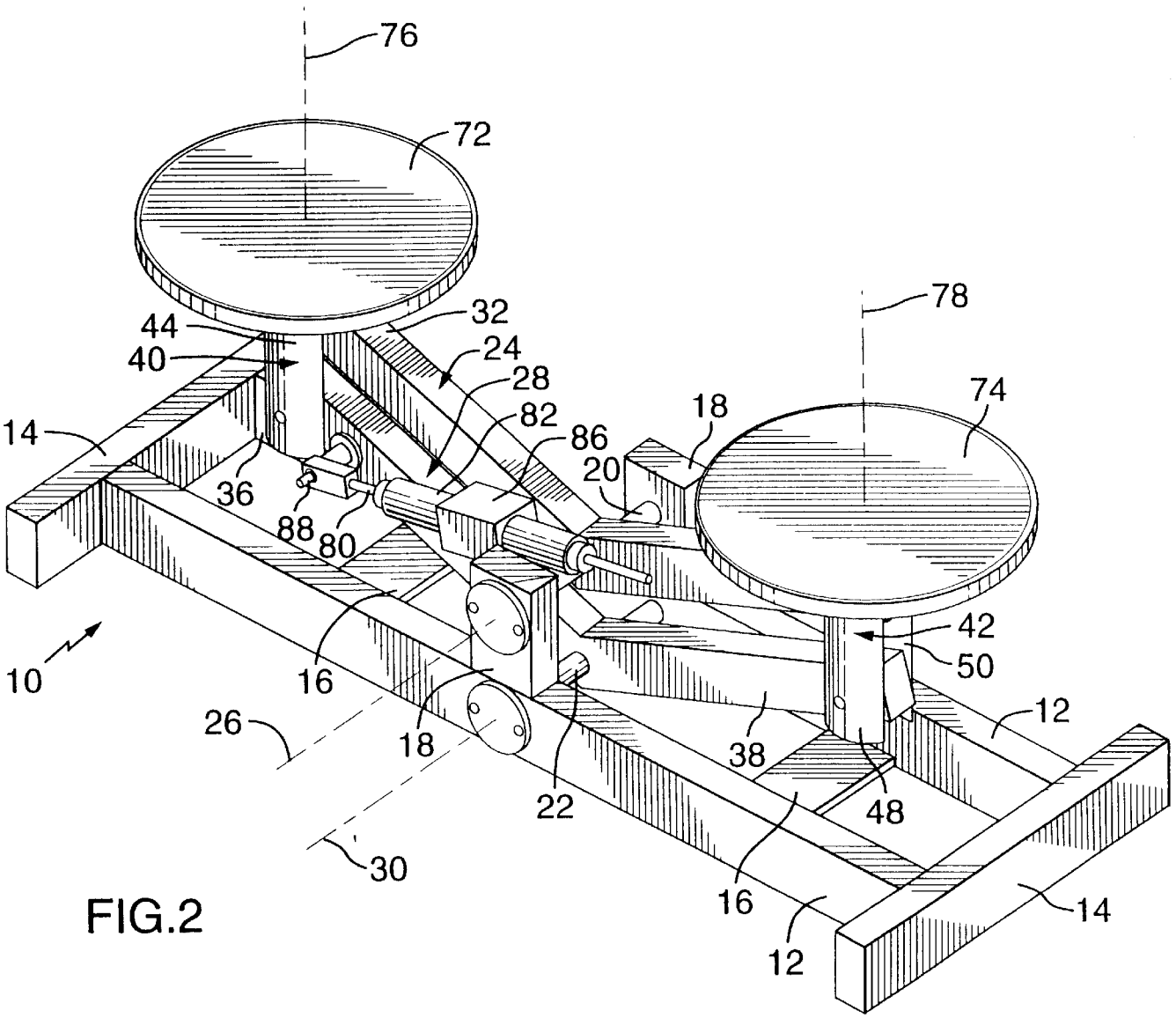
FIG. 2 is an enlarged view of the exerciser of FIG. 1 without the hand rail.

Reference is made first to FIGS. 1 and 2 which show a rigid base member 10 comprising a framework of a pair of longitudinal frame members 12 interconnected by a first pair of transverse frame members 14 and a second pair of transverse stop members 16. A pair of upright support posts 18 are secured centrally to each longitudinal frame member 12.

Two axle members extend transversely across the base member 10 as a primary axle member 20 and a secondary axle member 22. Two rigid pivot levers are provided consisting of a primary pivot lever 24 mounted on the primary axle member 20 for pivoting relative the base element 10 about a horizontal primary pivot axis 26 and a secondary pivot lever 28 mounted on the secondary axle member 22 for pivoting relative the base member 10 about a horizontal secondary pivot axis 30. The primary pivot lever 24 has a first end portion 32 and a second end portion 34. The secondary pivot lever 28 has a first end portion 36 and a second end portion 38.

A first foot platform support member 40 is mounted at the first ends of each of the primary lever 24 and the secondary lever 28. A second foot platform support member 42 is mounted on the second ends of the primary lever 24 and the secondary lever 28. Each foot platform support member 40 and 42 comprises a pair of spaced vertically extending bracket members 44, 46 and 48, 50 respectively, secured to extend downwardly from a circular support plate 52 and 54, respectively.

A pin 56 extends through the bracket members 44 and 46 so as to couple the first foot platform support member 40 to the primary lever 24 for pivoting about a first pivot axis parallel the primary axis 26. A pin 60 couples the bracket members 48 and 50 to the primary pivot lever 24 for pivoting about a second pivot axis parallel the primary axis 26. Similarly, a pin 64 pivots the bracket members 44 and 46 to the first end portion of the secondary lever 28 for pivoting about a first pivot axis parallel the primary axis. A pin 68 couples the bracket members 48 and 50 to the secondary pivot lever 28 at the second end portion for pivoting about a second pivot axis parallel the primary axis.

As is to be appreciated, with the first and second foot platform support members 40 and 42 pivotally coupled to the base member 10 via the primary and secondary levers 24 and 28 in this manner, on pivoting of the primary pivot lever 24 about the primary axis 26, the bracket members 40 and 42 are maintained vertical and, thus, the support plates 52 and 54 are maintained horizontal.

Figure 3:
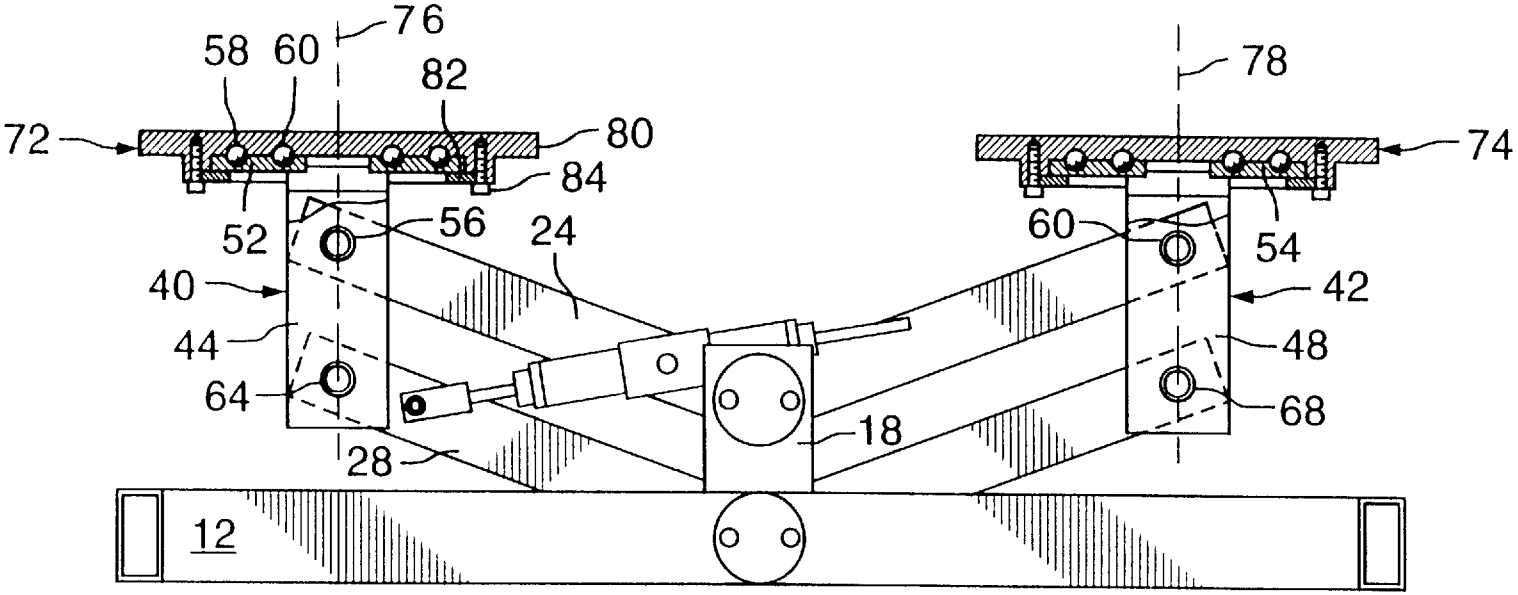
FIG. 3 is a front view of the exerciser in FIG. 2.
Figure 4:
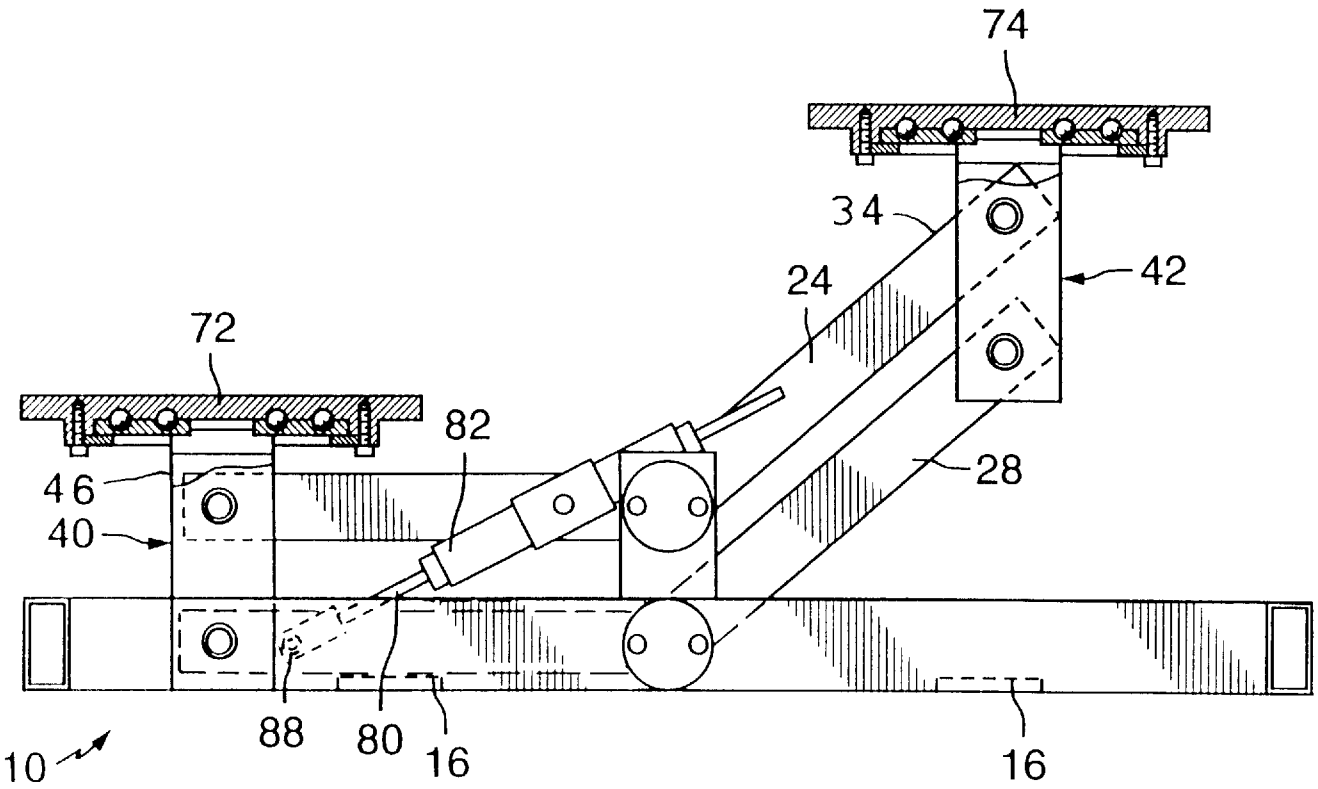
FIG. 4 is a front view of the exerciser of FIG. 2, however, with the teeter-totter mechanism tipped downwardly to the left.
Figure 5:
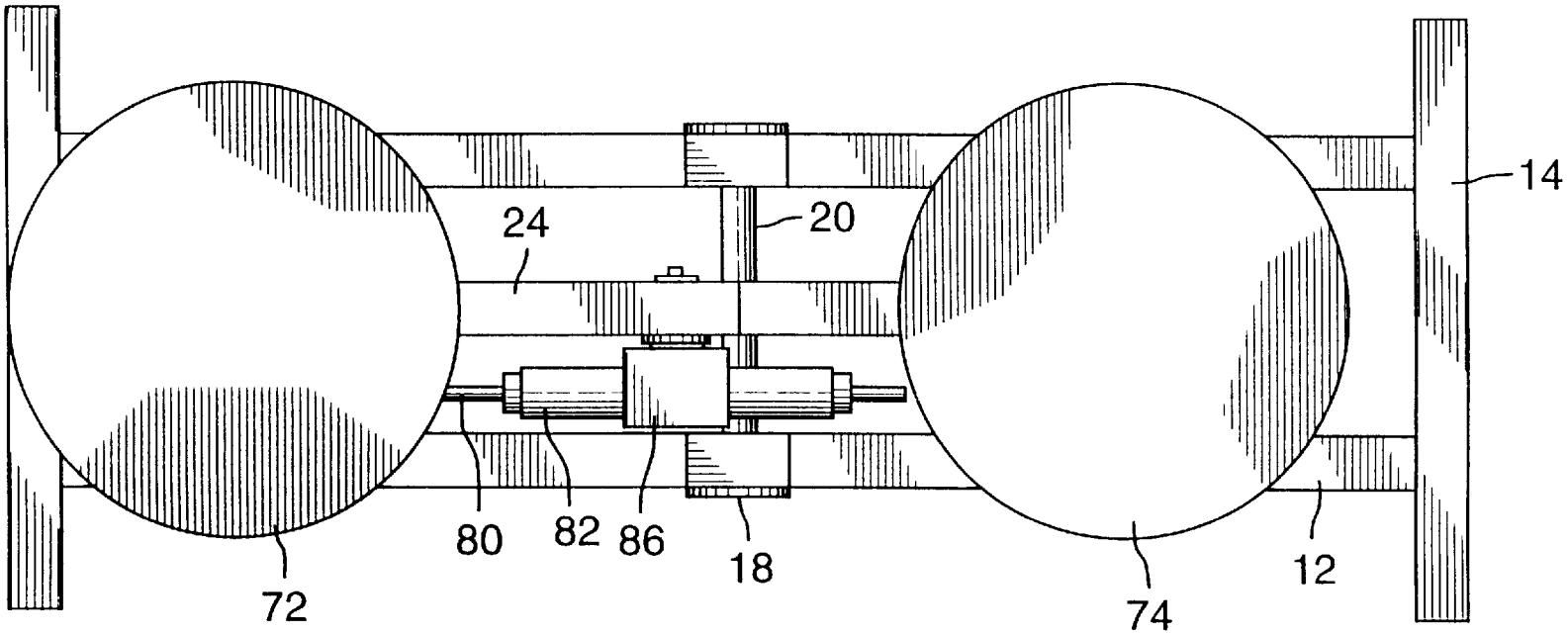
FIG. 5 is a top view of the exerciser shown in FIG. 4.

FIGS. 1, 2 and 3 show the exercise device in a configuration in which the support plates are disposed at equal height. FIG. 4 illustrates a position in which the first foot platform support member 40 has been pivoted to a maximum extent downwardly such that the secondary pivot lever 28 engages on the left-hand side transverse stop member 16.

Two foot platforms, namely, a first foot platform 72 and a second foot platform 74 are mounted to the respective first and second foot platform support members 40 and 42 by being secured coaxially above the circular support plates 52 and 54, respectively, journalled thereon for rotation about respective first and second vertical axes 76 and 78 passing centrally through each of the first and second foot platforms 72 and 74.

Two annular raceways of ball bearings 58, 60 are shown disposed between an upper plate 80 of the foot platform 72 and the circular support plate 52 retained in annular groove-like half raceways in each of the upper plate 80 and the support plate 52. The upper plate 80 is secured onto the support plate 52 by a lower ring plate 82 secured to the upper plate 80 by fasteners 84 with the circular support plate 52 received therebetween, free for relative rotation yet to retain the ball bearings in the raceways. Each of the first foot platform 72 and the second foot platform are free to rotate freely relative their respective foot platform support member about their respective vertical axes 76 and 78 and with each of the foot support plates being maintained horizontal in all positions to which the primary and secondary lever members 24 and 28 may pivot.

The teeter-totter device comprising the totality of the primary and secondary levers 24 and 28, the first and second foot platform support members 40 and 42 and the first and second foot platforms 72 and 74 is pivotable as a unit from the position shown in FIG. 4 in which the left-hand side has its secondary pivot lever 28 engaged on the stop member 16 on the left side to a mirror image position in which the right-hand side of the secondary pivot lever 28 is engaged on the stop member 16 on the right-hand side.

Figure 13:
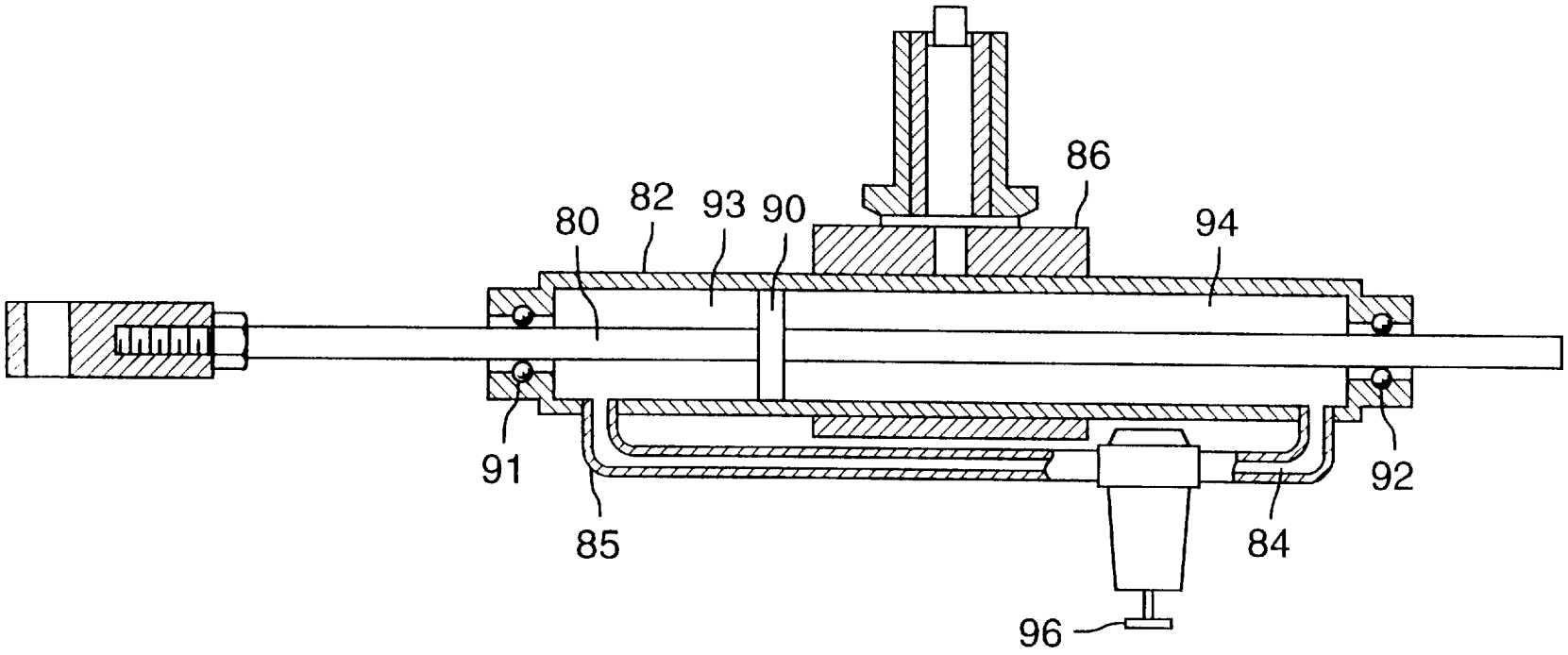
FIG. 13 comprises a schematic cross-sectional view of the resistance mechanism shown in FIGS. 1 to 5.

The preferred embodiment shows a mechanism whereby the resistance of the teeter-totter structure to pivoting may be varied. As schematically shown in FIG. 13, the resistance mechanism shown comprises a piston 80 received within a double ended cylinder 82 such that movement of the piston 80 within the cylinder 82 requires hydraulic fluid to flow through a passageway 84 in a connecting tube 85 from one side of the cylinder to the other. By restricting the size of an opening through the passageway 84, the resistance required to pivot the teeter-totter mechanism can be varied. Such resistance producing mechanisms are well known in the prior art. The resistance mechanism shown has the cylinder 82 clamped within a mounting block 86 which is pivotally secured to the left-hand arm of the primary pivot lever 24 for rotation about a horizontal axis. The piston 80 is an elongate rod disposed to be axially slidable within the cylinder 82 and having a left-hand end secured to the left-hand arm of the secondary pivot lever 28 for pivoting about a horizontal axis on a pivot pin 88 mounted to the secondary pivot lever. It is to be appreciated that the distance between the mounting block and pin 88 increases and decreases as a function of the relative angular position of the teeter-totter apparatus relative the base. As shown schematically in the cross-section of FIG. 13, the piston 80 carries a piston seal element 90. Seals 91 and 92 at each end of the cylinder 82 close the cylinder at each of its ends and, thus, forms two interior sealed chambers 93 and 94, one on each side of the piston seal element 90. Passageway 84 has two ends one open to chamber 93 and the other open to chamber 94 and, therefore, in movement of the piston 80 relative the cylinder, fluid must pass from one chamber in the cylinder to the other through the passageway 84. The passageway 84 is preferably provided with a valve 96 which can vary the cross-sectional area through which hydraulic fluid can flow through the passageway and thus increase or decrease the frictional forces required to pass hydraulic fluid from one cylinder to the other.

While the preferred embodiment shown in the drawings incorporates a mechanism for providing resistance, it is not necessary that any resistance be provided and in a preferred use, it is desired that the teeter-totter structure be able to be pivoted almost frictionless from one position to another. Thus, on one hand, the exerciser can be provided without a resistance mechanism and on the other hand when a resistance mechanism is provided, it is preferred that the resistance be low or preferably adjustable over ranges which include no resistance or low resistance. Known stepper exercisers have the function of providing resistance to movement of their foot pedals as to simulate climbing stairs and to significantly exercise the leg muscles of a user. Such known steppers provide substantial resistance to movement of the pedals. For example, with known steppers on a user placing all their weight on one foot pedal, the pedal is expected to descend slowly with its movement resisted and dampened. The exerciser of the present invention can have the resistance mechanism provide substantial resistance to movement such that like a known stepper even if all the weight of a user is placed on one foot pedal, the pedal will descend slowly.

However, the exerciser of the present invention is preferably for use in a manner that little or no resistance is provided to vertical movement of the foot pedals. In preferred use, the user is to maintain the relative height of each foot pedal by controlled placement of weight simultaneously on both foot pedals, that is, by maintaining equal weight on each foot pedal to balance in one position and by controlled transfer of only part of the user's weight from one foot pedal to the other to move from one balanced position to another. Thus, the present exerciser with no resistance to movement would require considerable balance skills to maintain relative desired heights of the foot pedals and controlled relative movement of the foot pedals particularly with varation of upper body positions. Providing some low resistance to pivoting of the teeter-totter structure to slightly dampen movement will make it easier for a user to maintain controlled balance and movement. However, such low resistance levels are much less than resistance levels utilized for conventional steppers whose object is to exercise by overcoming resistance.

In terms of the low levels of resistance which are preferred, such levels include levels which would permit one foot pedal to move from its highest position to its lowest position in less than one second when the weight applied to that foot pedal is about 4 kilograms greater than the weight on the other foot pedal, and more preferably, when the weight is less than 1 kilogram or less than 0.1 kilograms. Where resistance mechanisms such as frictional clutches are utilized, preferably the minimum weight differential required for movement of the foot pedals may preferably be less than 10 kilograms more preferably less than 1 kilogram or less than 0.1 kilograms. In other operations, however, it is desired that the resistance may be increased to desired relatively substantial levels, as for example, requiring in excess of 50 kilograms more applied to one foot pedal than the other to lower in less than one second or requiring in excess of 50 kilograms differential for initial movement.

FIG. 1 shows an adjustable height hand rail 94 being provided secured to the base as by extensions 96 of the transverse frame members 14 being provided secured thereto and presenting vertically extending base tubes 98. A U-shaped hand rail having vertically pole sections 100 and a horizontal hand grab bar section 102 is engaged within the vertical base tubes and adapted to be positioned at different heights by reason of spring buttons carried in the internal pole sections 100 extending into different holes provided in the base tubes. While the preferred hand rail structure shown is height adjustable and is provided adjacent one longitudinal side of the exerciser, it is to be appreciated that other structures may be provided adjacent the transverse ends on one or both of the ends as may be desired to provide a device which can be grasped by the hand of a user to steady a user utilizing the exerciser.

The preferred embodiment shows an exerciser device having a teeter-totter arrangement in which the foot platforms remain disposed horizontally in different angular positions of the teeter-totter device. Other structures may be utilized for the teeter-totter device without departing from the present invention. The preferred embodiment also shows one form of a resistance providing device. Other forms of resistance mechanisms may be provided including frictional clutch plate and the arrangement of different hydraulic or pneumatic cylinders or resistors or the like or mechanical resistors such as springs. For example, teeter-totter constructions such as those taught by U.S. Pat. No. 3,511,500 to Dunn, U.S. Pat. No. 5,298,022 to Lin or U.S. Pat. No. 5,518,470 to Piaget et al could be adopted in respect of the structure of their teeter-totter device and in respect of their resistance devices without departing from the scope of the present invention. Each of the devices of the above-noted patents could be adapted in accordance with the present invention so as to provide rotatable foot platforms in accordance with the present invention.

A method of exercising utilizing the exerciser in accordance with the present invention is now described with reference to FIGS. 6 to 12. Each of FIGS. 6 to 12 schematically show a human user on the exerciser in different relative orientations of the body and feet of a user. Each of the FIGS. 6 to 12, however, show the teeter-totter mechanism merely in a neutral position as shown in FIG. 1. It is to be appreciated, however, that a person using the teeter-totter device would, in adopting different of the positions as shown in FIGS. 6 to 12 and in moving between these positions, use the exerciser in a manner that the teeter-totter device is located in any angular position which the teeter-totter device is capable of adopting or in a manner that the teeter-totter device is moved from any positions the teeter-totter device is capable of adopting.

Figure 6:
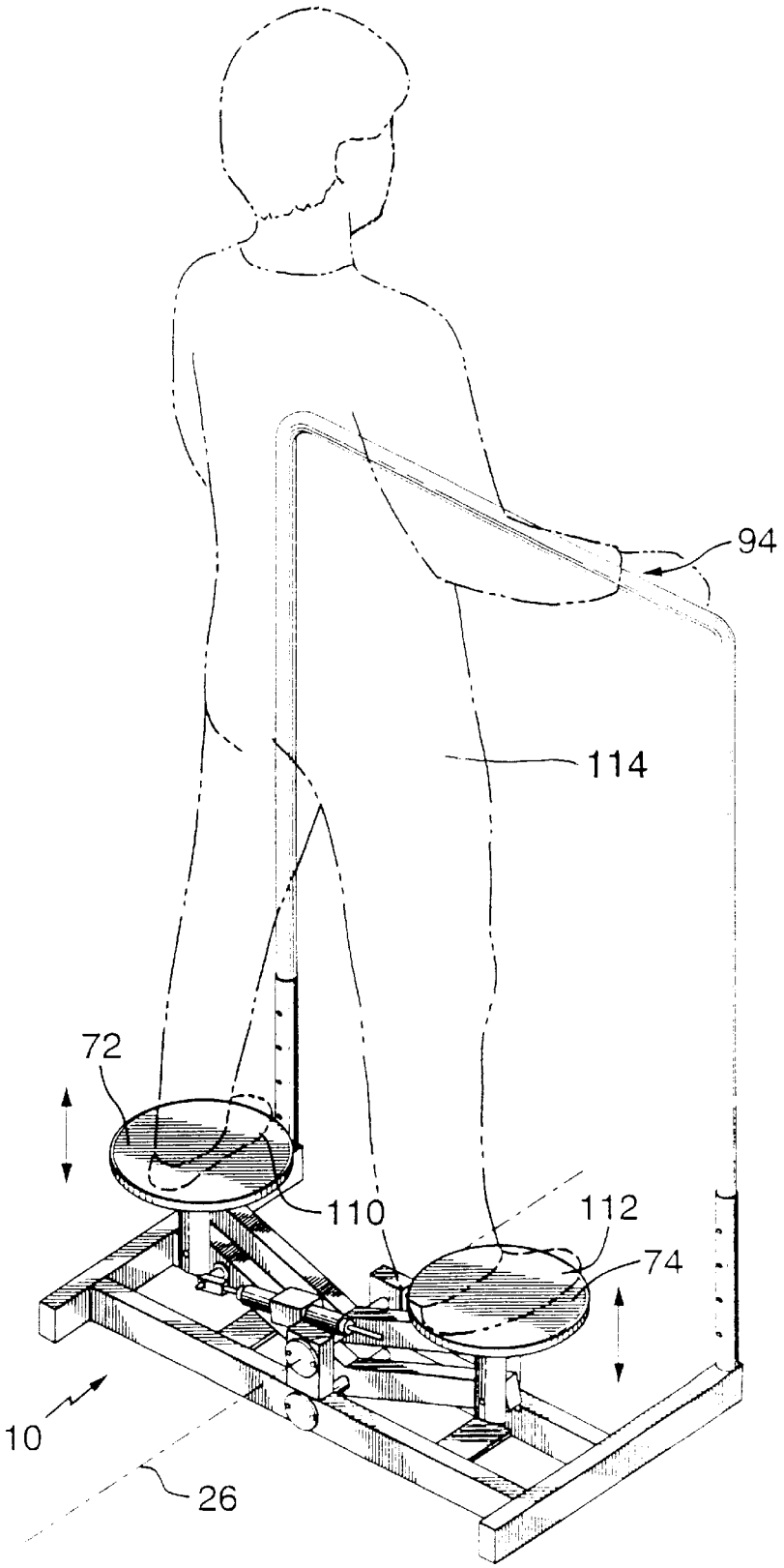
FIGS. 6 to 12 each comprise a pictorial view of the exerciser of FIG. 1 in the position of FIG. 1 and with a schematically illustrated user on the exerciser in different positions of use varying in respect of the orientation of the position of a user's feet and torso.

FIG. 6 shows a user in a position with both a user's left foot 110 and right foot 112 and the lower torso or hips 114 of the person disposed to extend forwardly towards the hand rail 94 parallel the primary axis 26. From this position, keeping the user's feet maintained in a position fixed on the foot platforms 72 and 74 and without changing the relative position of the user's feet on the foot platforms, a user may rotate each his left and right foot clockwise and, at the same time, rotate his hips so as to adopt the configuration shown in FIG. 7 with the hips 114 and both feet perpendicular the primary axis and in the case of FIG. 7 directed toward the right. From the position of FIG. 7, a person may then further rotate the footplates clockwise while maintaining his feet fixed on the footplates to a position shown in FIG. 8 with his hips and both feet directed rearwardly parallel the primary axis and with his legs in a cross twisted relation as shown. It is to be appreciated that from the position shown in FIG. 6, a user could similarly rotate the foot platforms counterclockwise so as to adopt positions which would be the mirror images of FIGS. 7 and 8.

With each foot platform being rotatable about their vertical axis, it is to be appreciated that with a person placing the bottom of his foot or shoe on a platform, preferably with a ball of a user's foot vertically above the vertical axis, exercising may be carried out and the foot platforms rotated substantially while maintaining a user's foot in constant contact and in the same orientation on the foot platform. Thus, exercising can freely take place without the need, for example, of frictionally twisting a user's foot relative the top surface of the foot platform.

Figure 7:
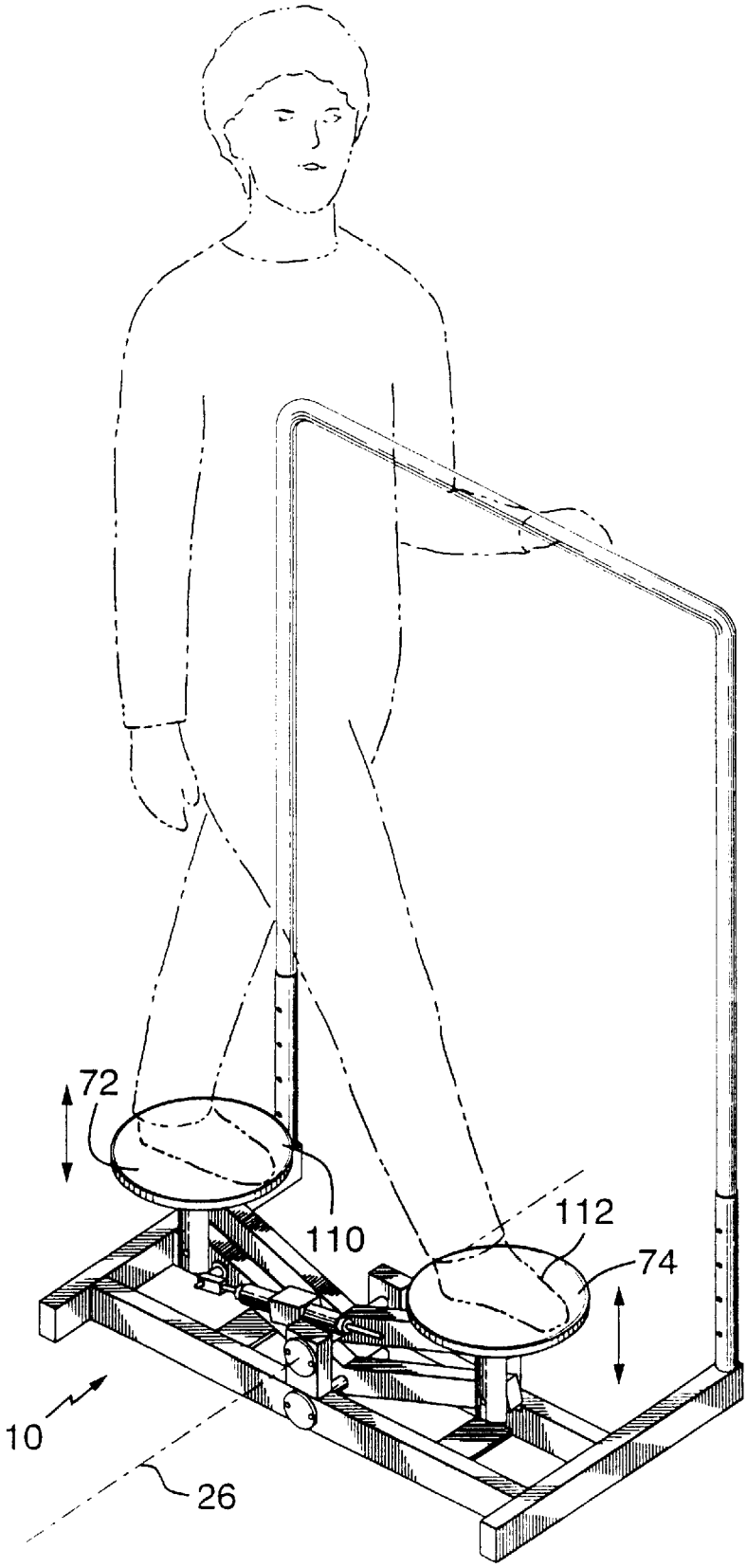
Figure 8:
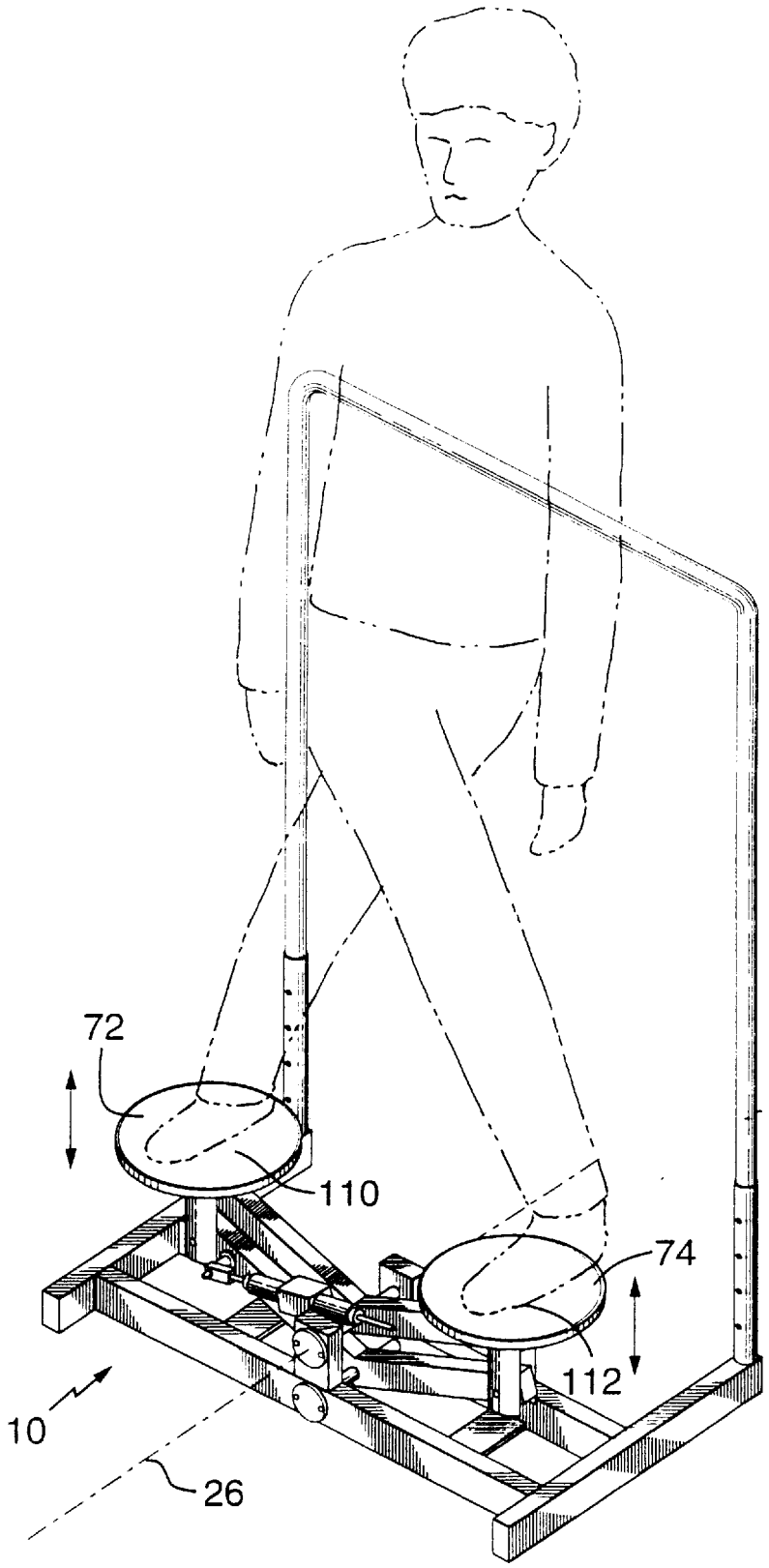
Figure 9:
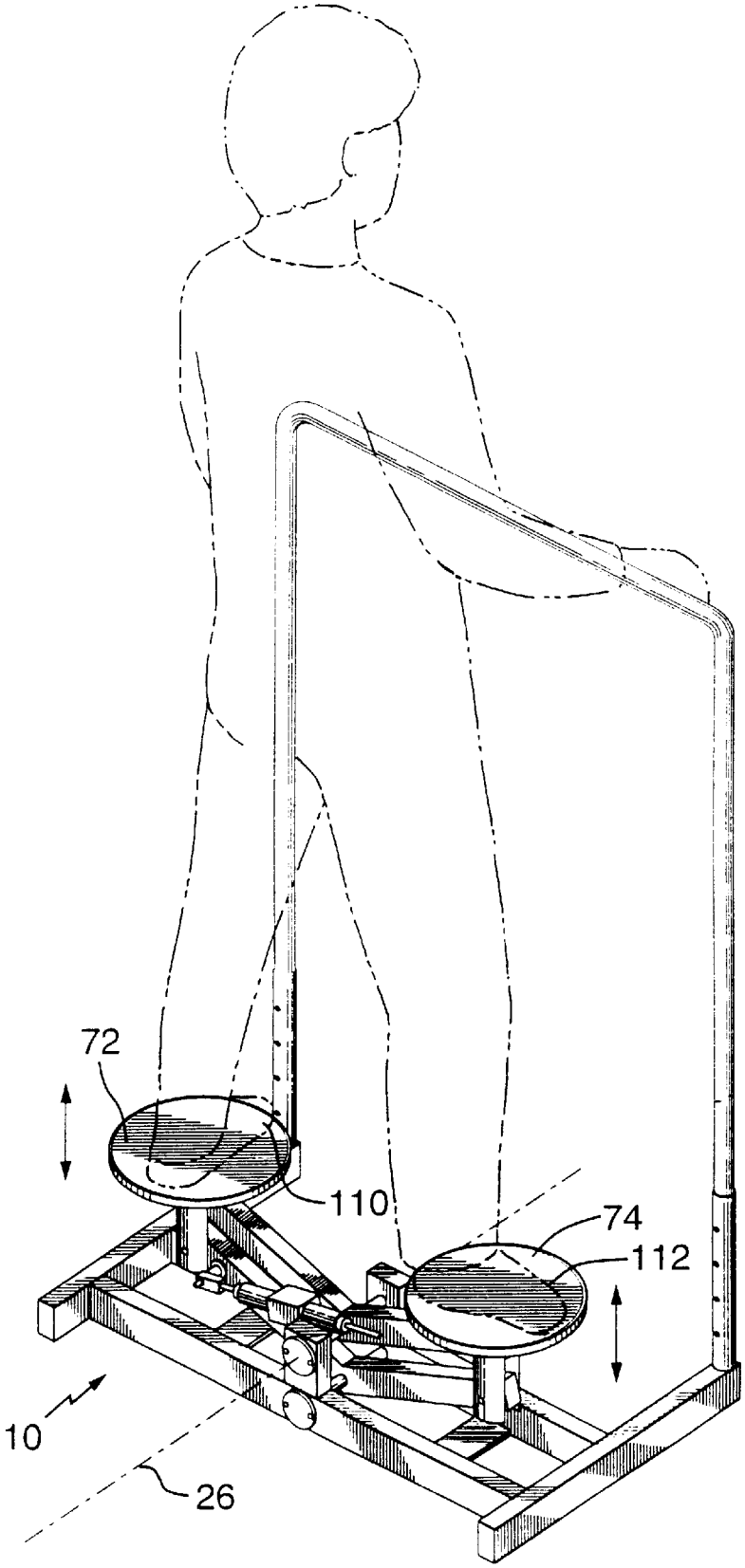
Figure 10:
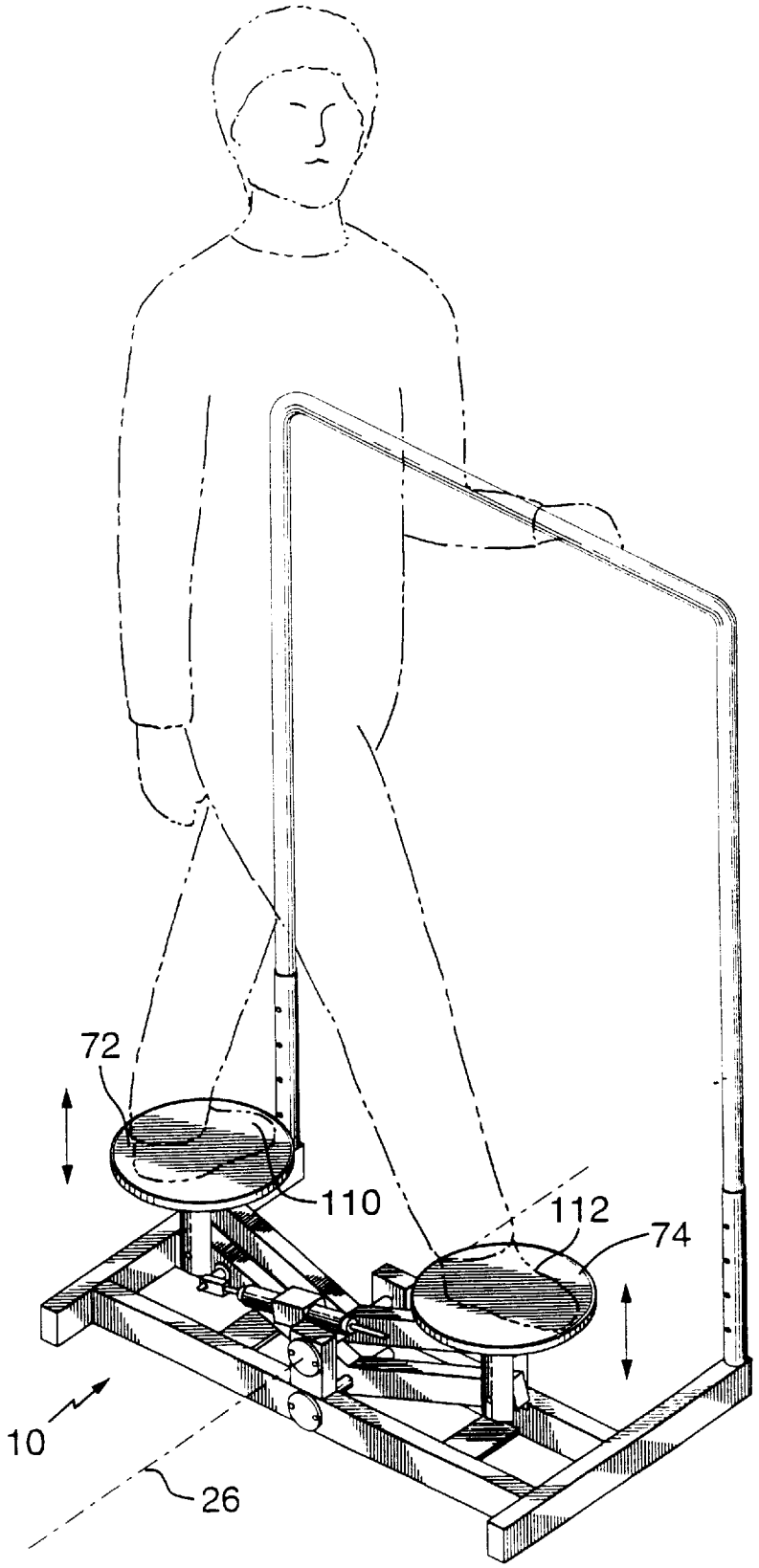
Figure 11:
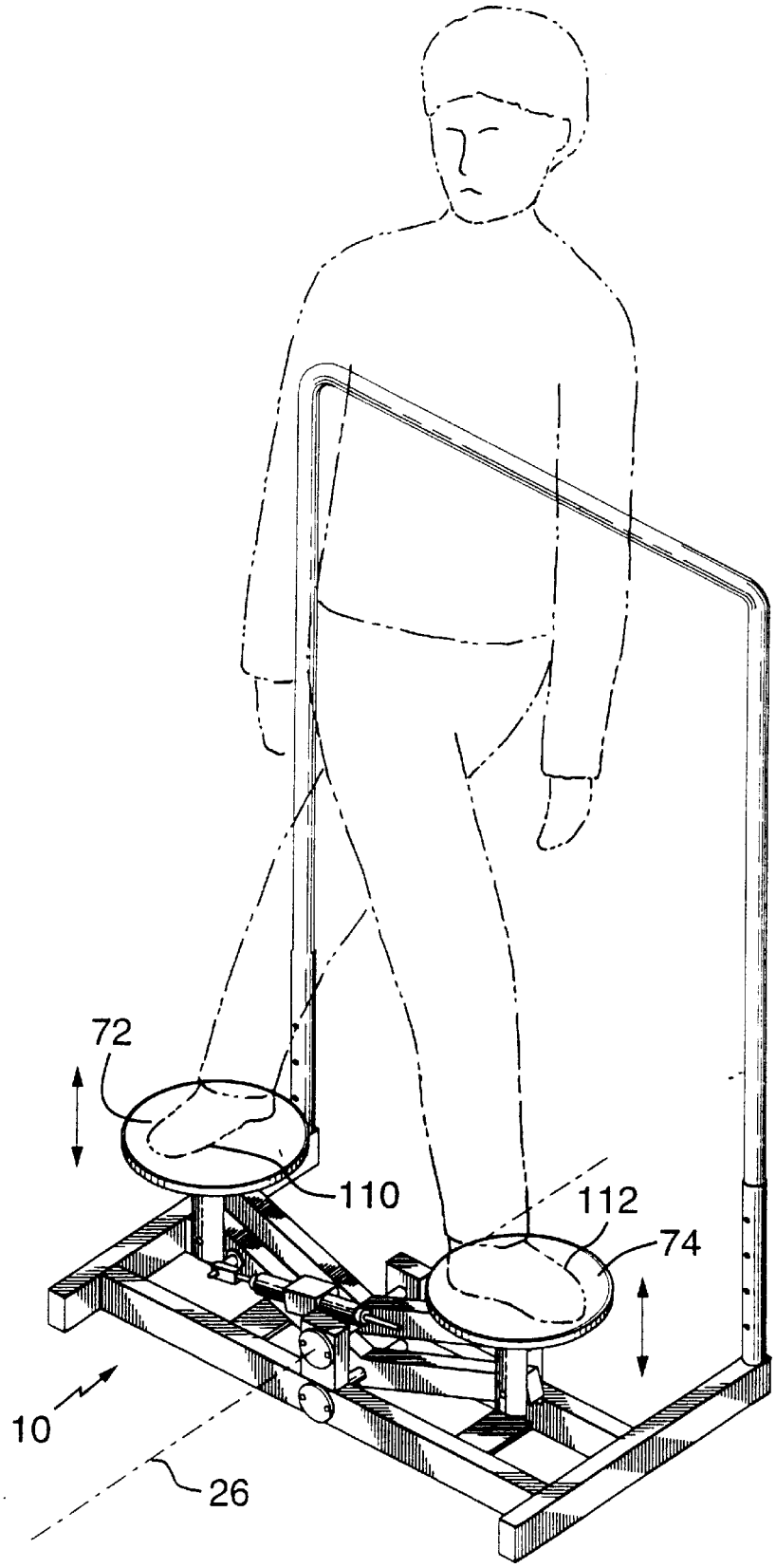

FIGS. 6 to 8 illustrate positions in which a person's feet while engaged on the foot platforms are disposed parallel to each other. FIGS. 9 to 11 illustrate three selected positions in which the person's feet are maintained on the foot platforms with the feet at different angular orientations and with one foot disposed parallel the primary axis 26 and the other foot disposed perpendicular the primary axis 26.

Figure 12:
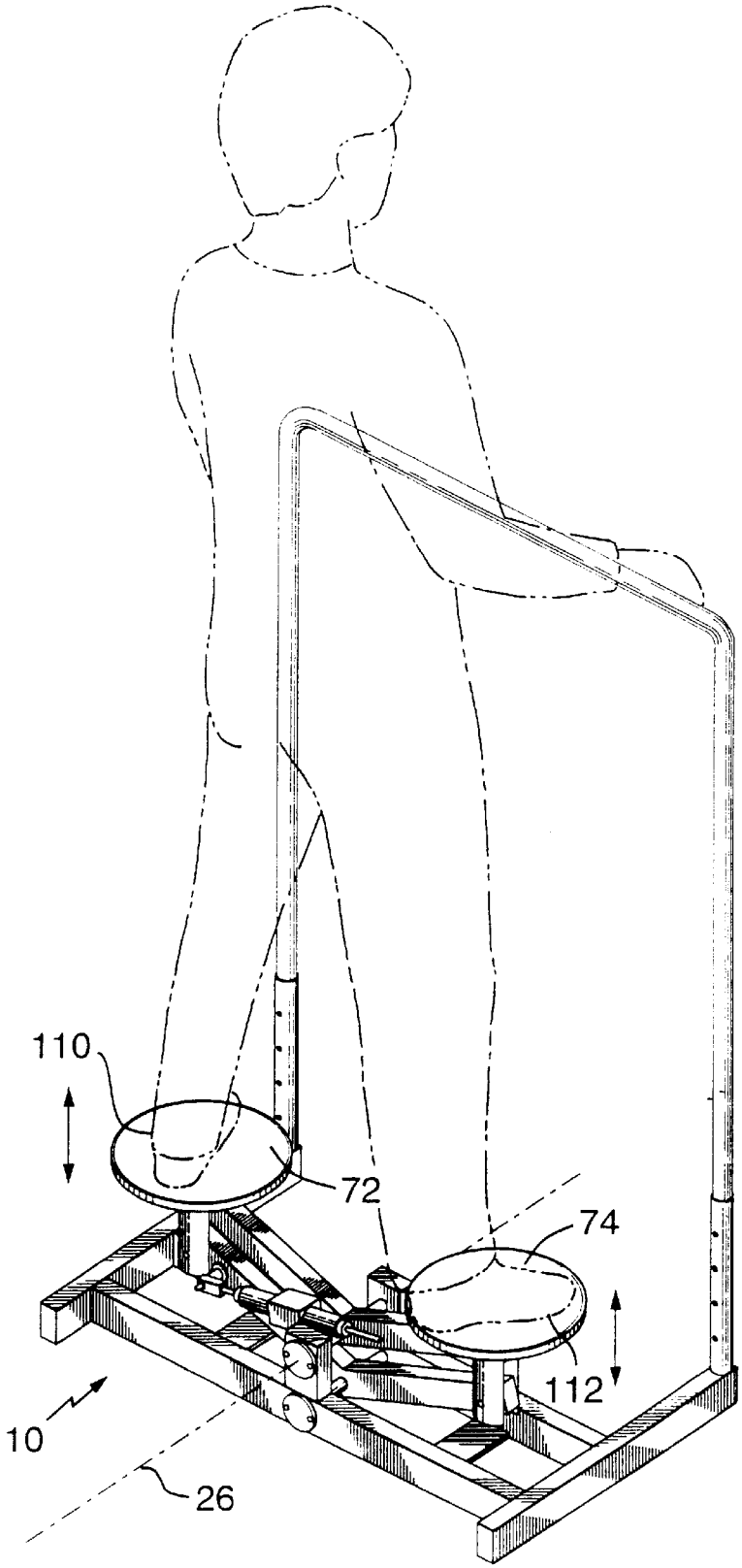

It is to be appreciated that a person's foot on being engaged on one of the rotatable foot platforms 72 and 74 can assume any angular orientations whatsoever. FIG. 12 illustrates a symmetrical orientation of a user's feet on the foot platforms as disposed at about 45 degree angles with the primary axis 26.

In a method of exercising in accordance with the present invention, while maintaining at least one foot constantly engaged with the foot platform, a user may twist that foot and/or torso so as to adopt varying positions of one's torso and/or feet relative the primary axis while simultaneously rocking the teeter-totter device in reciprocal pivoting movement of the teeter-totter device about the primary axis.

This method of exercising is believed to be advantageous in terms of promoting unique opportunities for extension and stretching of different muscle groups. A user can freely move between the different configurations while rocking the teeter-totter member and with or without use of the hand rail can develop suitable balancing skills.

The foot platforms are preferably of a diameter which is greater than the length of a typical foot of a user and, for example, may be a diameter in the range of about twelve inches. The distance between centers of the foot platforms 72 and 74, that is, the distance between the vertical axes 76 and 78, preferably, is approximately equal to the width of a user's shoulder although narrower or wider width could be utilized. Mechanisms could be provided so as to permit mounting of the foot platform support members at different distances apart on each of the primary and secondary levers as, for example, by having a series of different holes in each of the primary and secondary lever members and providing the pins 56, 60, 64 and 68 to be removable.

While the invention has been described with reference to preferred embodiments, it is not so limited. Many modifications and variations will now occur to persons skilled in the art. For a definition of the invention, reference is made to the appended claims.

I claim:

1. An exercise device comprising a base member an elongate primary pivot lever having first and second end portions, the primary lever pivotably mounted intermediate its first and second end portions on the base member for pivoting about a horizontal primary axis, first and second foot platform support members respectively mounted on the first and second end portions of the primary lever for pivoting relative the lever about respective first and second pivot axes parallel the primary axis, each first and second foot platform support members carrying respectively an upwardly directed first and second foot platform, linkage means maintaining each of the first and second foot platforms horizontal with pivoting of the primary lever about the primary axis;

each of the first and second foot platforms respectively mounted to and above the first and second foot platform support members journalled for rotation about respective first and second vertical axis centrally of each respective of the first and second foot platforms.

2. A device as claimed in claim 1 including adjustable resistance means for providing adjustable resistance to pivoting of said primary lever relative the base member about the primary axis.

3. A device as claimed in claim 1 wherein each of the first and second foot platforms comprise generally circular discs each journalled for rotation about the respective first and second vertical axis about a centre of each disc.

4. A device as claimed in claim 1 wherein said base member includes an upright support element, the primary pivot lever pivotally mounted to the upright support element for pivoting about the primary axis, the linkage means includes a secondary pivot lever having first and second end portions, the secondary pivot lever pivotably mounted intermediate its ends to the base member for pivoting about a horizontal secondary axis parallel the primary axis and spaced from the primary axis;

the first and second end portions of the secondary pivot lever pivotably coupled respectively to the first and second foot platform support members for pivoting about respective third and fourth pivot axis parallel the primary axis and spaced from the first and second pivot axis, respectively.

5. A device as claimed in claim 4 wherein the resistance means comprise a hydraulic cylinder connected between said primary pivot lever and the secondary pivot lever.

6. A device as claimed in claim 2 wherein the resistance means establishes equal resistance to pivoting of the primary pivot lever about the primary axis in both clockwise and counterclockwise directions.

7. A device as claimed in claim 6 wherein said resistance means is a hydraulic resistance mechanism.

8. A device as claimed in claim 1 including a hand support member mounted to the base member and extending upwardly therefrom adjacent the primary lever to provide a hand rail for grasping by the hands of a user whose feet are on the foot platforms.

9. A device as claimed in claim 2 wherein the resistance means comprises a hydraulic cylinder connected between said primary pivot lever and the linkage means.

10. A method of exercising with an exerciser device comprising;

the a step of providing the exercise device which comprises a base member, an elongate primary pivot lever having first and second end portions, the primary lever pivotably mounted intermediate its first and second end portions on the base member for pivoting about a horizontal primary axis, first and second foot platform support members respectively mounted on the first and second end portions of the primary lever for pivoting relative the lever about respective first and second pivot axes parallel the primary axis, each first and second foot platform support members carrying respectively an upwardly directed first and second foot platform, linkage means maintaining each of the first and second foot platforms horizontal with pivoting of the primary lever about the primary axis;

each of the first and second foot platforms respectively mounted to and above the first and second foot platform support members journalled for rotation about respective first and second vertical axis centrally of each respective of the first and second foot platforms, a step of a user mounting the exercise device with the weight of the user supported on the device by a first foot of the user on the first foot platform and a second foot of the user on the second foot platform, a step of the user maintaining fixed contact of portions of each of the first and second foot of the user with each of the respective first and second foot platforms while reciprocally pivoting the pivot lever by applying varying weight distribution from each of the first and second feet onto the respective first and second foot platforms, simultaneously with pivoting one or more of the first and second foot platforms about its respective first and second vertical axis.

11. A method as claimed in claim 10 wherein said pivoting one or more of the first and second foot platforms about its respective first and second vertical axis comprises pivoting between a position in which the user has both the first and second feet disposed parallel each other to positions in which at least one of the first and second foot is disposed at an angle to the other of the first and second foot.

12. A method as claimed in claim 11 wherein said pivoting of one or more of the first and second foot platforms about its respective first or second vertical axis includes the user moving his body such that the user pivots between a position in which the lower torso of a user faces parallel to the primary axis and a position in which the lower torso of the user faces perpendicular to the primary axis.

13. A method as claimed in claim 12 in which pivoting one or more of the first and second foot platforms about its respective first and second vertical axis includes pivoting to move between positions in which both feet are disposed parallel to the primary axis and the body of the user is positioned in a position in which the lower torso faces parallel to the primary axis and positions in which both feet are disposed perpendicular to the primary axis and the body of a user is disposed with the lower torso of the user in a position facing perpendicular to the primary axis.

14. A method as claimed in claim 10 in which a ball of each of the respective first and second foot of the user is disposed vertically above the respective first and second vertical axis on the respective first and second foot platforms, with the ball of each foot maintained in substantially constant fixed contact with the upper surface of the respective first and second foot platform during exercising.

* * * * *